US008813703B2

(12) United States Patent
Schaefer et al.

(10) Patent No.: US 8,813,703 B2
(45) Date of Patent: Aug. 26, 2014

(54) METHOD FOR ADJUSTING A CRANKSHAFT OF AN INTERNAL COMBUSTION ENGINE, CAMSHAFT ADJUSTMENT SYSTEM, AND INTERNAL COMBUSTION ENGINE HAVING AN ADJUSTABLE CRANKSHAFT

(75) Inventors: Jens Schaefer, Herzogenaurach (DE); Mike Kohrs, Oberreichenbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 552 days.

(21) Appl. No.: 13/060,147

(22) PCT Filed: Jul. 21, 2009

(86) PCT No.: PCT/EP2009/059373

§ 371 (c)(1),
(2), (4) Date: Feb. 22, 2011

(87) PCT Pub. No.: WO2010/020509

PCT Pub. Date: Feb. 25, 2010

(65) Prior Publication Data

US 2011/0146603 A1 Jun. 23, 2011

(30) Foreign Application Priority Data

Aug. 21, 2008 (DE) ..... 10 2008 039 007

(51) Int. Cl.
*F01L 1/02* (2006.01)

(52) U.S. Cl.
USPC ..... 123/90.31; 123/90.17; 123/90.32

(58) Field of Classification Search
USPC ..... 123/90.17, 90.31, 90.32; 29/888.011
See application file for complete search history.

(56) References Cited

U.S. PATENT DOCUMENTS

| | | | | |
|---|---|---|---|---|
| 6,718,929 | B2 * | 4/2004 | Onozawa et al. | 123/182.1 |
| 6,971,357 | B2 * | 12/2005 | Grieser et al. | 123/179.18 |
| 7,654,238 | B2 * | 2/2010 | Steiner et al. | 123/179.1 |
| 8,347,840 | B2 * | 1/2013 | Fleckner et al. | 123/179.3 |
| 2003/0000485 | A1 * | 1/2003 | Tomatsuri et al. | 123/41 E |
| 2003/0226534 | A1 | 12/2003 | Watanabe et al. | |
| 2006/0016411 | A1 | 1/2006 | Flanagan | |
| 2007/0051332 | A1 | 3/2007 | Uehama et al. | |
| 2007/0101956 | A1 * | 5/2007 | Schafer et al. | 123/90.15 |
| 2007/0245989 | A1 * | 10/2007 | Nguyen et al. | 123/90.17 |
| 2008/0053389 | A1 * | 3/2008 | Schafer et al. | 123/90.31 |
| 2009/0139478 | A1 * | 6/2009 | Dell et al. | 123/90.31 |

FOREIGN PATENT DOCUMENTS

| | | | |
|---|---|---|---|
| DE | 44 39 849 | A1 | 5/1996 |
| DE | 10 2004 006 337 | A1 | 8/2005 |
| DE | 10 2005 019 973 | A1 | 1/2006 |
| EP | 1 367 256 | A | 12/2003 |

(Continued)

*Primary Examiner* — Thomas Denion
*Assistant Examiner* — Jorge Leon, Jr.
(74) *Attorney, Agent, or Firm* — Davidson, Davidson & Kappel, LLC

(57) ABSTRACT

A method for adjusting a crankshaft of an internal combustion engine which has a camshaft adjuster that in turn has a triple-shaft gear mechanism with a setting shaft, a camshaft sprocket and a camshaft. The camshaft sprocket is drivably connected to the crankshaft. During motor standstill or in a transition phase, in which at least one of the three shafts of the triple-shaft gear mechanism stands still, a driving of the setting shaft occurs. Also, a camshaft adjustment system is disclosed which has a triple-shaft gear mechanism with a control device that adjusts the crankshaft during the motor standstill or in a transition phase.

9 Claims, 1 Drawing Sheet

(56) References Cited

FOREIGN PATENT DOCUMENTS

| | | | |
|---|---|---|---|
| EP | 1 607 589 | A | 12/2005 |
| EP | 1 630 363 | A | 3/2006 |
| EP | 1 895 114 | A | 3/2008 |
| WO | 01/88344 | A | 11/2001 |
| WO | 2005080757 | A1 | 9/2005 |
| WO | 2006/018080 | A1 | 2/2006 |

* cited by examiner

METHOD FOR ADJUSTING A CRANKSHAFT OF AN INTERNAL COMBUSTION ENGINE, CAMSHAFT ADJUSTMENT SYSTEM, AND INTERNAL COMBUSTION ENGINE HAVING AN ADJUSTABLE CRANKSHAFT

This application is a 371 of PCT/EP2009/059373 filed Jul. 21, 2009, which in turn claims the priority of DE 10 2008 039 007.0 filed Aug. 21, 2008, the priority of both applications is hereby claimed and both applications are incorporated by reference herein.

FIELD OF THE INVENTION

The invention relates to a method for adjusting a crankshaft of an internal combustion engine by means of a camshaft adjuster having a three-shaft gearing. Generic methods are used in particular in so-called start-stop concepts for internal combustion engines. The invention also relates to a camshaft adjuster and to an internal combustion engine having a crankshaft which can be adjusted when the engine is at a standstill.

BACKGROUND OF THE INVENTION

For the adjustment of a camshaft, the prior art discloses inter alia electromechanical camshaft adjustment systems. In electromechanical camshaft adjustment systems, use is usually made of three-shaft gearings in which a first shaft of the gearing, usually the drive input shaft, is connected to the camshaft sprocket of an internal combustion engine, a second shaft (drive output shaft) is operatively connected in terms of drive to the camshaft via the camshaft sprocket, and a third shaft, the adjusting shaft, is connected to the rotor shaft of an electric adjusting motor (electric motor). The adjusting shaft serves for adjusting the relative angular position between the camshaft and crankshaft during operation of the internal combustion engine. Examples of such three-shaft gearings are swashplate gearings and internal eccentric gearings, which are described in WO 2006/018080. Said three-shaft gearings also include the shaft gearing known from WO 2005/080757 and the gearings in US 2007/0051332 A1 and US 2003/0226534 A1.

As actuators in such three-shaft systems, electric motors are often used for adjusting the adjusting shaft. It is however likewise possible to use electrical, mechanical or hydraulic brakes or rotationally or linearly acting electromagnets to permit the phase adjustment.

All of the known camshaft adjuster systems are designed, in terms of their operating principle and/or their dimensions, for the phase adjustment of the camshaft during engine operation. With such systems, it is not possible for the actuator and actuating element to also be used for pre-positioning the crankshaft when the engine is at a standstill.

SUMMARY OF THE INVENTION

It is an object of the invention to provide strategies which make it possible, by means of an electromechanical camshaft adjuster, to rotate the crankshaft of an internal combustion engine from a standstill in order thereby to pre-position the piston position and if appropriate the camshaft phase position for the following starting process of the internal combustion engine.

The object is achieved by a method for adjusting a crankshaft, a method for adjusting a camshaft, and an internal combustion engine which has a camshaft adjusting system.

In a method according to the invention for adjusting a crankshaft of an internal combustion engine which has an electromechanical camshaft adjuster with a three-shaft gearing, while the engine is at a standstill or in a transition phase in which at least one of the three shafts of the three-shaft gearing is stationary, an actuating shaft is driven in order to adjust completely or partially the angular position of a timing assembly, to adjust the angular position of the crankshaft and if appropriate to adjust the angular position of one or more camshafts.

The three-shaft gearing serves for power branching. It is governed by the following physical relationships:

Rotational speeds: $n_A - i_{0_AC} \times n_C - (1 - i_{0_AC}) \times n_B = 0$, where $n_A$, $n_B$ and $n_C$ are the rotational speeds of the three shafts of the three-shaft gearing. In the present case, therefore, $n_A$ is the rotational speed of the camshaft, $n_B$ is the rotational speed of the adjusting shaft, and $n_C$ is the rotational speed of the camshaft sprocket; $i_{0_AC}$ is the static transmission ratio between the shafts A and C when the shaft B is stationary, that is to say in this case between the drive input and drive output shafts of the three-shaft gearing (the static transmission ratio is determined from the tooth count ratios of the gearing stages in the three-shaft gearing, the transmission ratio between the camshaft and crankshaft of i=0.5 results from the tooth count ratio in the timing assembly).

The sum of the external torques is zero: $T_A + T_B + T_C = 0$.

The power for each shaft is calculated as follows: $P = 2\pi \times n \times T$.

For the adjustment or pre-positioning of the shaft A (=camshaft) or C (=camshaft sprocket, fixed with respect to the crankshaft) by means of the actuator (electric motor, actuating shaft), the drive power of the actuator must be transmitted to the shaft to be positioned. If only one of the two shafts is adjusted by means of the actuating shaft, the power for the shaft which is not to be adjusted must be zero. In the simplest case, the shaft is thus to be held stationary (that is to say n=0).

For the pre-positioning of the camshaft sprocket and crankshaft, the torque of the camshaft ($T_{Camshaft}$) must correspondingly be greater than the torque of the crankshaft acting on the camshaft sprocket ($T_{Camshaft\text{-}sprocket} = T_{Crankshaft} * 0.5$), that is to say $T_{Camshaft} > T_{Camshaft\text{-}sprocket}$ or $T_A > T_C$, in order to ensure that no part of the power of the actuator is transmitted into the camshaft. Such a torque ratio is more likely to be encountered in engines with a small number of cylinders and a high level of camshaft friction (for example when using bucket tappets). In larger engines, therefore, it is necessary if appropriate to provide a device for blocking the camshaft.

The torque ratio in the shafts may also be varied by relieving the timing assembly and crank drive of load, for example by decompression or by slackening the chains of the timing assembly.

A camshaft adjustment system having a three-shaft gearing and enhanced according to the invention comprises a control device which permits an adjustment of the actuating shaft when at least one of the other two shafts of the three-shaft gearing is stationary.

In a preferred embodiment, the camshaft adjustment system comprises an additional pre-transmission gearing which provides an additional (pre-)step-down ratio of the drive connection between the actuator (for example electric motor) and actuating shaft of the actuating element (three-shaft gearing). The pre-transmission gearing may be arranged between the actuating shaft and the actuator housing or between the actuating shaft and actuating element housing (camshaft sprocket). Furthermore, in this embodiment, the camshaft adjustment system comprises a control device for carrying out the method according to the invention.

The ability to adjust the crankshaft angle when the engine is at a standstill by means of the camshaft adjustment system according to the invention makes it possible to pre-position the shaft and therefore the gas piston in order to realize a direct start of the internal combustion engine without the need for further assemblies such as starters or positioning motors. To control inter alia the compression, air quantity, ignitability and catalytic converter heating, the pre-positioning of the crankshaft may take place with or without a superposed variation of the camshaft phase angle.

An activation of the camshaft adjustment system is preferably triggered, in order to set and hold the desired crankshaft angle and/or camshaft angle, by means of a switch or a signal, for example via a CAN bus, or by the opening of the driver's door of the vehicle or by the seat occupation or the like.

The method according to the invention should also be active in the transition phases between the engine coming to a standstill and a starting process, and between the engine coming to a standstill and a shut-down process. Such a transition phase is present for example when one of the three shafts of the camshaft adjuster is already or still stationary or, in the case of engines having a plurality of adjustment systems, individual shafts are stationary and the other shafts are still rotating.

Pre-positioning of the timing assembly, of the crankshaft and/or of the camshaft may take place in a regulated or unregulated manner. In the case of unregulated pre-positioning, a "blind" adjustment is carried out in one direction. In the case of regulated adjustment, a continuous nominal value-actual value comparison is carried out. Regulated operation is generally preferable.

According to the invention, three adjustment strategies can be applied:

1. The camshaft is stationary during the positioning of the crankshaft.
2. The camshaft co-rotates during the positioning of the crankshaft.
3. The camshaft is initially stationary and is subsequently dragged along.

Regardless of the selection of one of the three possible adjustment strategies, when the engine is at a standstill, the following conditions must be taken into consideration for the pre-positioning of the crankshafts:

- In internal combustion engines having a plurality of camshaft adjustment systems (for example for inlet and outlet camshafts), it should be possible by means of a corresponding circuit for all the actuators to be utilized synchronously for adjusting the crankshaft.
- The dragging of the crankshaft should preferably take place counter to the normal drive direction of the timing assembly. Here, the normal drive direction is to be understood to mean the usual rotational direction of the engine (forward). The oppositely-directed rotation of the crankshaft has the advantage that the tensile strand is tautened for the subsequent start. In another embodiment, the pre-positioning may however also take place, without regard to the chain tension of the actuating drive, in the direction of least rotational resistance in order to save positioning time and energy. If required, the timing assembly is subsequently tautened again by a rotation in the opposite direction.
- Freewheels should preferably be provided in the respective hubs in the assembly drive and in the connections to auxiliary units of the camshaft or crankshaft, in order that said components do not need to be dragged along in the opposite rotational direction during the pre-positioning. Freeweels of said type are in part already provided.
- The crankshaft should be decoupled from the vehicle transmission during the pre-positioning process. This may take place by means of an automated clutch or else by means of a freewheel. Here, it is necessary to use a securing facility which prevents the vehicle from inadvertently rolling away when the transmission is decoupled.
- A device for cylinder decompression should preferably be provided in order to reduce the drag torque of the crankshaft. The device decompresses the cylinder prior to the driving of the actuating shaft.

In a particularly preferred embodiment, the crankshaft and camshaft positions are measured by a sensor system, and the adjusting direction is selected so as to utilize the shorter adjustment path in order, for the direct start concept, to position the optimum piston out of 1 to 4 in the case of a four-cylinder engine with the least time and energy expenditure.

To be able to implement the method according to the invention in an internal combustion engine, certain requirements must be met both with regard to the camshaft adjuster and also with regard to the internal combustion engine:

- In relation to a conventional camshaft adjuster, the camshaft adjustment system requires a more powerful electric motor with a motor constant ke>13 mVs/rad, which must be provided additionally in the case of passive camshaft adjusters.
- A total step-down ratio of greater than 1:50 or 1:−50 must be adhered to between the actuating shaft and the drive output shaft, in this case the camshaft sprocket.
- The mechanisms and electronics of the camshaft adjuster must be designed so as to meet the increased demands.
- The internal combustion engine must, by means of a generator (alternator), provide the required electrical energy of >100 W.
- The camshaft breakaway torque, the camshaft drag torque, the crankshaft breakaway torque and the crankshaft drag torque must in each case be <30 Nm.
- An active camshaft and crankshaft sensor is preferably used for the precise determination of the crankshaft and camshaft position.

The stated requirements need not all be met in parallel. With a corresponding design, the absence of one or more specific requirements may be compensated.

DETAILED DESCRIPTION OF THE INVENTION

Figure 1:
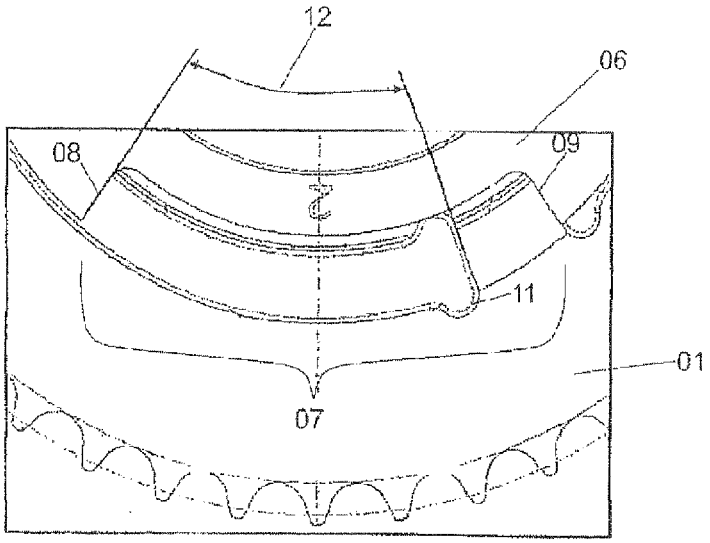
FIG. 1 shows a partial view of a camshaft adjustment system.
Figure 2:
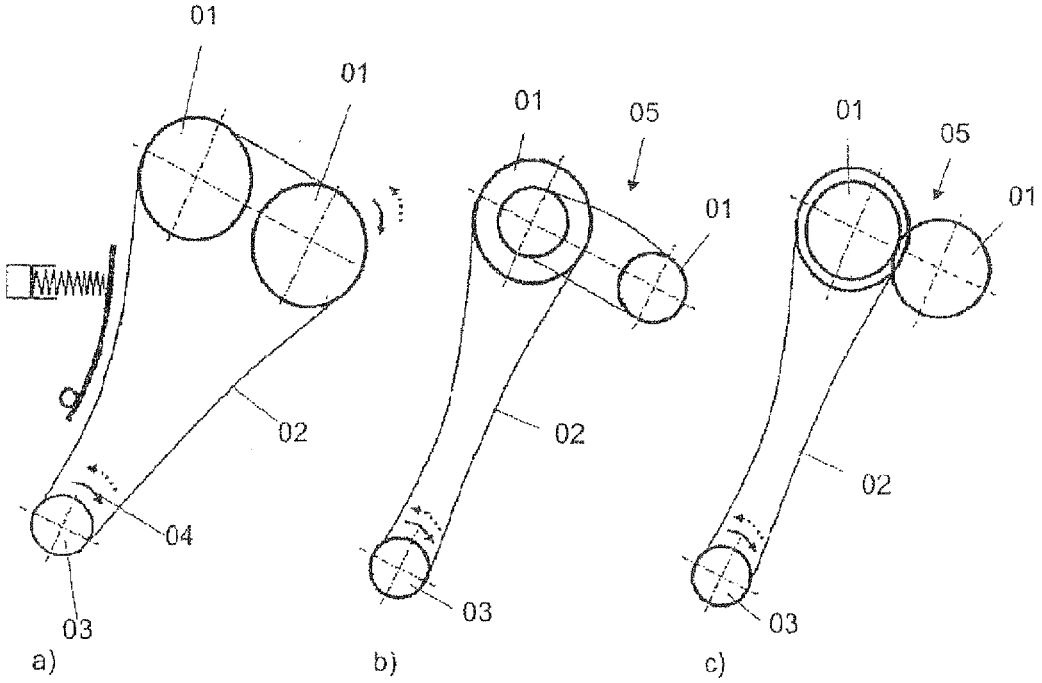
FIG. 2 show schematic views of three configuration variants of a timing assembly.

The design of a camshaft adjuster and the different adjustment strategies according to the invention will be explained below on the basis of FIGS. 1 and 2. A camshaft sprocket 01 is operatively connected, as an actuating element of a camshaft adjuster, to a crankshaft 03 via a chain 02. Said components form the timing assembly. During normal operation of an internal combustion engine, the crankshaft 03 drives the one or more camshaft sprockets 01 in a rotational direction 04 at half of the crankshaft rotational speed.

Further actuating elements or camshafts and camshaft adjusters (for example for separate camshafts for inlet and outlet valves) may also be arranged in the timing assembly. Further actuating elements and camshafts may be arranged in a separate secondary drive 05 (FIG. 2, images b and c). The secondary drive 05 may be designed in a known way as a chain drive (image b) or as a spur gear drive (image c). The primary drive may also be designed as a spur gear drive.

A stop disk 06 is connected to a camshaft for conjoint rotation therewith (not illustrated). The stop disk 06 has a cutout 07 which defines a boundary of the adjustment range. The cutout 07 has, spaced apart from one another angularly, an early stop 08 and a late stop 09. A stop lug 11 on the camshaft sprocket 01 is provided such that the camshaft sprocket 01 and stop disk 06 can be rotated relative to one another between the stops 08, 09.

During normal operation of the camshaft adjuster, said stops 08, 09 determine the range of phase adjustment of the camshaft relative to the crankshaft 03. In this way, the valve opening times are adapted in a known way to the varying load conditions in the internal combustion engine in order to obtain an increase in efficiency. When the internal combustion engine is shut down, without the use of so-called start-stop strategies, the relative position between the camshaft sprocket 01 and stop disk 06 is not determined, that is to say the stop lug in the sprocket is positioned within the cutout 07.

Adjustment Strategy 1:

According to a first adjustment strategy, the timing assembly and crankshaft 03 are now rotated within an adjustment range 12 by means of the camshaft sprocket 01 for the purpose of pre-positioning the crankshaft 03. The adjustment range 12 is determined by the spacing or the angle between the stop lug 11 and one of the stops 08, 09. For this purpose, the actuating shaft is driven by the electric motor as an actuator. During this time, the camshaft is stationary.

The advantage of this strategy is that, when the camshaft is stationary, the camshaft sprocket 01 has a step-down ratio relative to the actuating shaft similar to that during normal operation of the internal combustion engine, that is to say when the camshaft sprocket 01 is rotating as a reference system relative to the camshaft-side drive output wheel. Depending on the application, it is possible to dispense with a separate step-down gearing for further increasing the transmission ratio (=pre-transmission ratio).

In conventional camshaft adjusters, however, the angle range between the stops 08, 09 is limited to less than 180° crank angle on account of fail-safe concepts. Furthermore, the crankshaft must be positioned substantially without regard to the camshaft phase angle, which could possibly adversely affect the starting and exhaust-gas characteristics. Depending on the friction conditions present, the camshaft must possibly be held fixed by means of an auxiliary device (for example locking facility or brake device) during the positioning of the crankshaft.

Position determination of the crankshaft 03 may take place by referencing the stop lug 11 to one of the two end stops 08, 09 of the stop disk 06 and with the knowledge of the camshaft angle and the adjusting shaft angle. The crankshaft position is preferably determined directly. Independently of this, so-called active crankshaft and/or camshaft sensors are necessary because parts of the internal combustion engine are stationary at the time of adjustment. Active sensors are to be understood to mean sensors which are fed with a voltage and which are capable of sensing even at low rotational speeds down to engine standstill.

Adjustment Strategy 2:

A second adjustment strategy is used if the camshaft adjuster has been shut down at one of the two stops 08, 09. When using a start-stop strategy, the corresponding stop may already be actively set during the shutting-down of the internal combustion engine. Here, the selection of which stop should be approached in the stop strategy used is dependent on the dragging direction and the type of adjustment gearing.

An adjustment in the direction of the late stop must be used in the case of a negative transmission ratio of the three-shaft gearing with dragging direction of the timing assembly to the right and rotational direction of the actuator motor to the right, or in the case of a positive transmission ratio of the three-shaft gearing with dragging direction of the timing assembly to the left and rotational direction of the actuator motor to the left. An adjustment in the direction of the early stop must be used in the case of a positive transmission ratio of the three-shaft gearing with dragging direction of the timing assembly to the right and rotational direction of the actuator motor to the right, or in the case of a negative transmission ratio of the three-shaft gearing with dragging direction of the timing assembly to the left and rotational direction of the actuator motor to the left.

The camshaft is initially stationary (or must possibly additionally be held fixed). In each case, when the other end stop is reached, the camshaft is dragged along in the drive direction of the camshaft adjuster and therefore of the crankshaft. In the case of inverse dragging operation, the opposite end stop is correspondingly to be used.

A particular advantage of this adjustment strategy is that any desired crankshaft angles can be set. However, the electric motor must drag the timing assembly, crankshaft and camshaft with a 1:1 ratio, and therefore a separate pre-transmission gearing is required in order to increase the effective transmission ratio, or the electric motor must be dimensioned similarly to a starter machine.

After the crankshaft start position has been assumed, a retroactive pre-adjustment of the camshaft phase position is optionally possible before the injection takes place and ignition commences in the internal combustion engine.

Adjustment Strategy 3:

In a third adjustment strategy, firstly, with the aid of the high transmission ratio of the three-shaft gearing, during an adjustment of the camshaft sprocket within the adjustment range 12 (according to the first adjustment strategy), the timing assembly and the crankshaft should be dragged out of the state of static friction. When the stop 08 or 09 is reached (depending on the dragging direction), it is possible, with a pre-transmission ratio upstream of the actuating shaft, for the crankshaft 03 to be adjusted beyond the adjustment range 12. A smaller pre-transmission ratio is required here than is required in the second adjustment strategy, because the breakaway torque of the crankshaft 03 has already been overcome.

Said strategy requires that, when the internal combustion engine is shut down, the camshaft adjuster assumes a camshaft phase position outside a drag stop, and therefore can always be dragged with the high transmission ratio. The drag stop is the stop beyond which the camshaft is then driven along.

LIST OF REFERENCE NUMERALS

01 Camshaft sprocket
02 Chain
03 Crankshaft
04 NORMAL rotational direction
05 Secondary drive
06 Stop disk
07 Cutout
08 EARLY stop
09 LATE stop
10 —
11 Stop lug
12 Adjustment range

The invention claimed is:

1. A method for adjusting a crankshaft of an internal combustion engine having a camshaft adjuster with a three-shaft gearing, comprising an actuating shaft, a camshaft sprocket and a camshaft, the method comprising the following steps:

connecting the camshaft sprocket in terms of drive to the crankshaft; and driving the actuating shaft while the engine is at a standstill or in a transition phase in which at least one shaft of the three-shaft gearing is stationary, wherein the internal combustion engine has cylinders and the cylinders are decompressed before the actuating shaft is driven.

2. The method as claimed in claim 1 wherein the camshaft adjuster further comprises an adjusting motor connected to the actuating shaft and actuatable to adjust the relative angular position between the camshaft and the crankshaft during operation of the internal combustion engine, the method comprising driving the actuating shaft by the adjusting motor of the camshaft adjuster while the engine is at the standstill or in the transition phase in which at least one shaft of the three-shaft gearing is stationary.

3. The method as claimed in claim 1, wherein the crankshaft is driven by the actuating shaft opposite a normal drive direction of the crankshaft.

4. The method as claimed in claim 1, wherein the actuating shaft is driven in a direction with a least rotational resistance.

5. The method as claimed in claim 4, wherein the direction of the least rotational resistance is determined as a function of the crankshaft position.

6. The method as claimed in claim 1, including decoupling the crankshaft from a vehicle transmission before driving the actuating shaft.

7. The method as claimed in claim 1, wherein the camshaft adjuster has two mechanical end stops, the camshaft being stationary during an adjustment of the crankshaft, and an adjustment of the actuating shaft taking place within an adjustment range between the two mechanical end stops of the camshaft adjuster.

8. The method as claimed in claim 1, wherein the camshaft co-rotates during an adjustment of the crankshaft.

9. The method as claimed in claim 1, wherein the camshaft adjuster has an end stop and wherein the camshaft is initially stationary during an adjustment of the crankshaft and, during a further adjustment of the crankshaft, the camshaft and the crankshaft co-rotate after reaching the end stop on the camshaft adjuster.

* * * * *